US007140925B2

(12) United States Patent
Allison et al.

(10) Patent No.: US 7,140,925 B2
(45) Date of Patent: Nov. 28, 2006

(54) POWER CONNECTOR WITH SAFETY FEATURE

(75) Inventors: Jeffrey W. Allison, Etters, PA (US); Brian M. Rohrbaugh, Glen Rock, PA (US); Robert F. Evans, Bedford, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/148,093

(22) Filed: Jun. 8, 2005

(65) Prior Publication Data

US 2005/0227514 A1 Oct. 13, 2005

Related U.S. Application Data

(63) Continuation of application No. 10/352,531, filed on Jan. 28, 2003, now abandoned.

(51) Int. Cl.
*H01R 13/64* (2006.01)

(52) U.S. Cl. ..... 439/680; 439/633

(58) Field of Classification Search ..... 439/680, 439/633

See application file for complete search history.

(56) References Cited

U.S. PATENT DOCUMENTS

| | | | | |
|---|---|---|---|---|
| 3,497,850 A | | 2/1970 | Gallo, Sr. | 337/197 |
| 3,750,092 A | | 7/1973 | Bury | 339/192 RL |
| 3,789,348 A | | 1/1974 | Lenaerts et al. | 339/198 R |
| 3,910,671 A | | 10/1975 | Townsend | 339/97 R |
| 3,944,312 A | | 3/1976 | Koenig | 339/59 R |
| 4,005,923 A | | 2/1977 | Davis, Jr. | 339/157 |
| 4,073,564 A | | 2/1978 | Davis, Jr. | 339/157 |
| 4,224,486 A | * | 9/1980 | Zimmerman et al. | 439/681 |
| 4,227,762 A | | 10/1980 | Scheiner | 339/91 R |
| 4,500,160 A | | 2/1985 | Bertsch | 339/166 |
| 4,626,637 A | | 12/1986 | Olsson et al. | 200/284 |
| 4,659,158 A | | 4/1987 | Sakamoto et al. | 339/19 |
| 4,669,801 A | | 6/1987 | Worth | 439/404 |
| 4,685,886 A | | 8/1987 | Denlinger et al. | 439/55 |
| 4,709,976 A | | 12/1987 | Nakama et al. | 439/350 |
| 4,780,088 A | | 10/1988 | Means | 439/107 |
| 4,790,763 A | | 12/1988 | Weber et al. | 439/65 |
| 4,790,764 A | | 12/1988 | Kawaguchi et al. | 439/78 |
| 4,801,271 A | * | 1/1989 | Piper | 439/148 |
| 4,818,237 A | * | 4/1989 | Weber | 439/693 |
| 4,820,175 A | | 4/1989 | Hasegawa et al. | 439/98 |
| 4,838,809 A | | 6/1989 | Mouissie | 439/155 |

(Continued)

FOREIGN PATENT DOCUMENTS

DE 23 50 834 4/1975

(Continued)

OTHER PUBLICATIONS

FCI, "PwrBlade® Power Distribution Connector System," 2003, www.fciconnect.com, 2 pages.

(Continued)

*Primary Examiner*—Briggitte R. Hammond
(74) *Attorney, Agent, or Firm*—Woodcock Washburn LLP

(57) ABSTRACT

Electrical receptacle connectors are provided including an insulative housing and AC power contacts disposed therein that are configured for engaging an external power supply. The receptacle connectors are employed with a safety guard for restricting operator access to hot AC power contacts when disconnected from complementary header connectors. Preferred safety guards include projections extending along at least a portion of perimeter areas surrounding housing apertures that provide access to engaging portions of the AC power contacts. The projections define a safety gap between human digits directed toward the housing apertures and the AC power contacts.

18 Claims, 5 Drawing Sheets

U.S. PATENT DOCUMENTS

| | | | | | |
|---|---|---|---|---|---|
| 4,845,592 | A | | 7/1989 | Himes, Jr. et al. | 361/407 |
| 4,875,865 | A | | 10/1989 | Demler, Jr. et al. | 439/101 |
| 4,881,905 | A | | 11/1989 | Demler, Jr. et al. | 439/79 |
| 4,900,271 | A | | 2/1990 | Colleran et al. | 439/595 |
| 4,915,641 | A | | 4/1990 | Miskin et al. | 439/247 |
| 4,917,625 | A | | 4/1990 | Haile | 439/358 |
| 4,941,830 | A | | 7/1990 | Tkazyik et al. | 439/59 |
| 4,950,186 | A | | 8/1990 | Kaley et al. | 439/882 |
| 4,954,090 | A | | 9/1990 | Shimochi | 439/76 |
| 4,968,263 | A | | 11/1990 | Silbernagel et al. | 439/246 |
| 4,990,099 | A | * | 2/1991 | Marin et al. | 439/284 |
| 5,046,960 | A | | 9/1991 | Fedder | 439/108 |
| 5,107,328 | A | | 4/1992 | Kinsman | 357/74 |
| 5,108,301 | A | | 4/1992 | Torok | 439/263 |
| 5,139,426 | A | | 8/1992 | Barkus et al. | 439/65 |
| 5,152,700 | A | | 10/1992 | Boguresky et al. | 439/733 |
| 5,158,471 | A | | 10/1992 | Fedder et al. | 439/80 |
| 5,173,063 | A | * | 12/1992 | Barkus et al. | 439/681 |
| 5,207,591 | A | | 5/1993 | Ozaki et al. | 439/212 |
| 5,238,416 | A | * | 8/1993 | Dickie | 439/148 |
| 5,281,168 | A | | 1/1994 | Krehbiel et al. | 435/595 |
| 5,295,843 | A | | 3/1994 | Davis et al. | 439/108 |
| 5,358,422 | A | | 10/1994 | Schaffer et al. | 439/346 |
| 5,362,249 | A | | 11/1994 | Carter | 439/357 |
| 5,376,012 | A | | 12/1994 | Clark | 439/80 |
| 5,403,206 | A | | 4/1995 | McNamara et al. | 439/608 |
| 5,435,876 | A | | 7/1995 | Alfaro et al. | 156/247 |
| 5,481,442 | A | * | 1/1996 | Dickie et al. | 439/373 |
| 5,549,480 | A | | 8/1996 | Cheng | 439/79 |
| 5,582,519 | A | | 12/1996 | Buchter | 439/101 |
| 5,588,852 | A | * | 12/1996 | Puerner | 439/135 |
| 5,590,463 | A | | 1/1997 | Feldman et al. | 29/844 |
| 5,605,489 | A | | 2/1997 | Ale et al. | 451/28 |
| 5,618,187 | A | | 4/1997 | Goto | 439/79 |
| 5,622,511 | A | | 4/1997 | Jarrett | 439/248 |
| 5,643,013 | A | | 7/1997 | Wiedler et al. | 439/660 |
| 5,667,392 | A | | 9/1997 | Kocher et al. | 439/79 |
| 5,716,234 | A | | 2/1998 | Phillips | 439/595 |
| 5,785,557 | A | | 7/1998 | Davis | 439/660 |
| 5,865,651 | A | | 2/1999 | Dague et al. | 439/680 |
| 5,872,046 | A | | 2/1999 | Kaeriyama et al. | 438/465 |
| 5,879,198 | A | | 3/1999 | Sekimori et al. | 439/700 |
| 5,904,594 | A | | 5/1999 | Lougueville et al. | 439/608 |
| 5,923,995 | A | | 7/1999 | Kao et al. | 438/460 |
| 5,924,899 | A | | 7/1999 | Paagman | 439/701 |
| 5,937,140 | A | | 8/1999 | Leonard et al. | 392/392 |
| 6,027,360 | A | | 2/2000 | Jenkins | 439/364 |
| 6,062,911 | A | | 5/2000 | Davis et al. | 439/630 |
| 6,063,696 | A | | 5/2000 | Renner et al. | 438/465 |
| 6,178,106 | B1 | | 1/2001 | Umemoto et al. | 363/146 |
| 6,190,215 | B1 | | 2/2001 | Pendleton et al. | 439/853 |
| 6,319,075 | B1 | * | 11/2001 | Clark et al. | 439/825 |
| 6,335,224 | B1 | | 1/2002 | Peterson et al. | 438/114 |
| 6,358,094 | B1 | | 3/2002 | Belopolsky et al. | 439/637 |
| 6,394,818 | B1 | | 5/2002 | Smalley, Jr. | 439/79 |
| 6,402,566 | B1 | | 6/2002 | Middlehurst et al. | 439/699.1 |
| 6,471,523 | B1 | | 10/2002 | Shuey | 439/63 |

FOREIGN PATENT DOCUMENTS

| | | |
|---|---|---|
| DE | 34 41 416 A1 | 5/1986 |
| DE | 40 01 104 A1 | 7/1991 |
| EP | 0 465 013 | 1/1992 |
| EP | 0 724 313 | 7/1996 |
| EP | 0 951 102 A2 | 10/1999 |
| FR | 2 699 744 | 6/1994 |
| GB | 2 168 550 | 6/1986 |
| JP | 09 055 245 | 2/1997 |

OTHER PUBLICATIONS

FCI, "PwrBlade® Power Distribution Connector System," *Technology Innovation Service*, 2003, 2-3.
FCI, "PwrBlade™, new Power Distribution connector for electronic applications," *Product News*, 2003, www.fciconnect.com, 1 page.
FCI, "Act Connectors in action," *Panorama*, 2003, 1 page.
U.S. Appl. No. 09/944,266, filed Aug. 31, 2001, Schell.

* cited by examiner

POWER CONNECTOR WITH SAFETY FEATURE

CROSS-REFERENCE TO RELATED APLICATIONS

This is a continuation of U.S. application Ser. No. 10/352,531, filed on Jan. 28, 2003, now abandoned.

FIELD OF THE INVENTION

The present invention relates to electrical power connectors that are useful in circuit board or backplane interconnection systems. Connectors of the present invention include a safety feature that restricts access to hot AC power contacts housed within the connectors.

BACKGROUND OF THE INVENTION

There has been significant evolution in the area of electrical connectors, with improvements including multi-function consolidation within a single connector housing, and employment of features for effective heat dissipation generated from electrical power transmission. For example, Clark et al., in U.S. Pat. No. 6,319,075, disclose an electrical connector including both power and signal contacts within a single insulative housing, thereby eliminating the need for two separate connectors. Preferred power contacts disclosed in the '075 patent employ a "dual-mass" principle that provides a greater surface area available for heat dissipation, as compared to "single-mass" designed contacts, such as, for example, those having a circular or pin-like cross section.

Electrical connectors similar to those above may further comprise an AC power cable port and AC power contacts for direct connection with an external power supply. Examples of such connectors are commercially available from FCI Electronics, Inc. FCI's PWRBLADE brand connector series includes a receptacle connector that consists of AC power contacts, DC power contacts, signal contacts, and a shrouded AC cable port. Each of the power contacts includes two contact walls with a space therebetween to facilitate heat dissipation. Two patent applications owned by the assignee of the instant application and generally related to power distribution connectors, U.S. patent application Ser. No. 09/160,900 filed Sep. 25, 1998 and Ser. No. 09/944,266 filed Aug. 31, 2001, are currently pending in the U.S. Patent & Trademark Office, and are incorporated by reference herein.

Power distribution connectors that are engaged with an AC power cable plug when the mating face is unconnected to a complementary connector, may provide access of foreign objects to engaging portions of the hot AC power contacts. Accordingly, there is room for improvement in the art.

SUMMARY OF THE INVENTION

The present invention is related to electrical connectors having contacts for transmitting electrical power and electrical signals in a single connector. In accordance with a preferred embodiment of the present invention, there has now been provided an electrical connector comprising an insulative housing including a connector mating face, and an AC power contact disposed in the insulative housing. The connector mating face comprises an aperture to provide access to an engaging portion of the AC power contact, and a guard for preventing direct human touching of the engaging portion.

In accordance with another preferred embodiment of the present invention, there has now been provided an electrical connector comprising an insulative housing, and an AC power contact disposed in the insulative housing. The power contact includes an engaging portion comprising two spaced apart contact walls. The insulative housing includes a mating face having an aperture therein to provide access to the AC power contact, and a guard proximate a perimeter of the aperture to define an electrical shock safety gap of at least about 5 mm between a human digit that is directed towards the aperture and the engaging portion of the AC power contact.

In accordance with yet another preferred embodiment of the present invention, there has now been provided an electrical connector comprising an insulative housing having a mating face, a plurality of AC power contacts, a plurality of DC power contacts, and a plurality of signal contacts. The mating face comprises a plurality of spaced apart apertures to provide access to a mating portion of a power or signal contact, and at least one outwardly directed projection extending along at least a portion of a perimeter defined by each of the apertures corresponding to the plurality of AC power contacts.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

DETAILED DESCRIPTION OF ILLUSTRATIVE EMBODIMENTS

Figure 1:
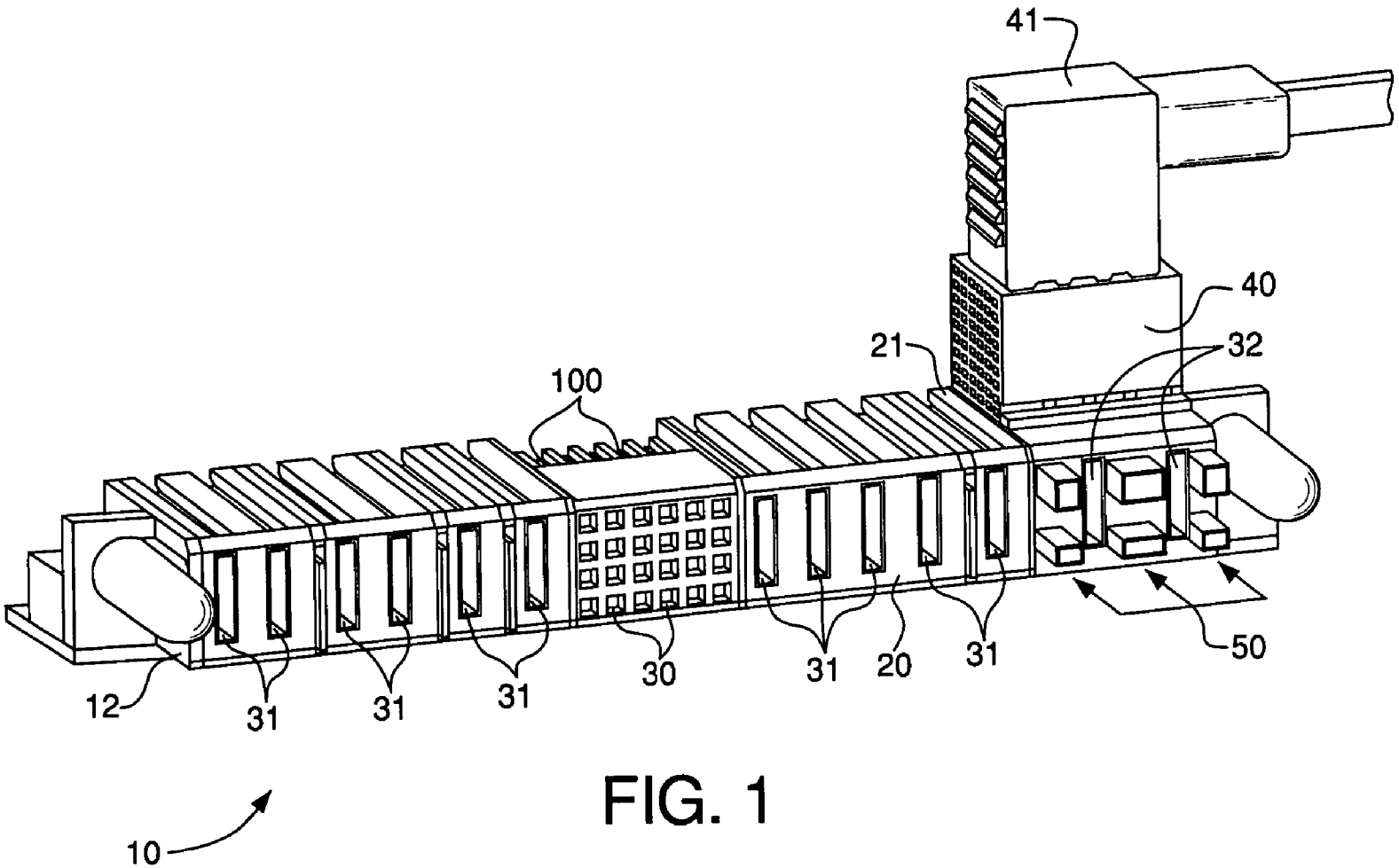
FIG. 1 is a perspective view of an electrical connector embodiment provided by the present invention including anti-shock guard projections extending from its mating face.

The present invention is believed to be best understood through the following detailed description of preferred embodiments and the accompanying drawings wherein like reference numbers indicate like features. Referring to FIG. 1, an electrical receptacle connector 10 is shown including an insulative housing 12 having a mating face 20 for receiving a complimentary header connector (not shown).

Mating face 20 contains a plurality of apertures that provide access to electrical contacts disposed in insulative housing 12. Apertures 30 provide access to engaging portions of signal contacts 100, apertures 31 provide access to engaging portions of DC power contacts 80 (shown in FIG. 7), and apertures 32 provide access to engaging portions of AC power contacts 70 (shown in FIG. 6). Although the number and arrangement of the various apertures is identical in all of the figures herein, connectors covered by the appended claims may have any number of contacts and corresponding apertures that are arranged in various configurations.

A shrouded AC cable port 40 extends from a top portion 21 of housing 12. An external power supply is provided by way of an AC power cable plug 41, which is shown partially inserted within AC cable port 40. Preferred connectors may alternatively be configured so that AC cable port 40 extends from a bottom portion or rear portion of housing 12. AC power cable plug 41 engages vertically-oriented AC power contacts 70 (shown in FIG. 6). An anti-shock guard 50 is employed to restrict direct operator access (that is, direct human touching without the aid of a tool) to the hot AC power contacts 70 during times when AC power cable plug 41 is engaged and receptacle connector 10 is disconnected from a complementary header connector.

Figure 2:
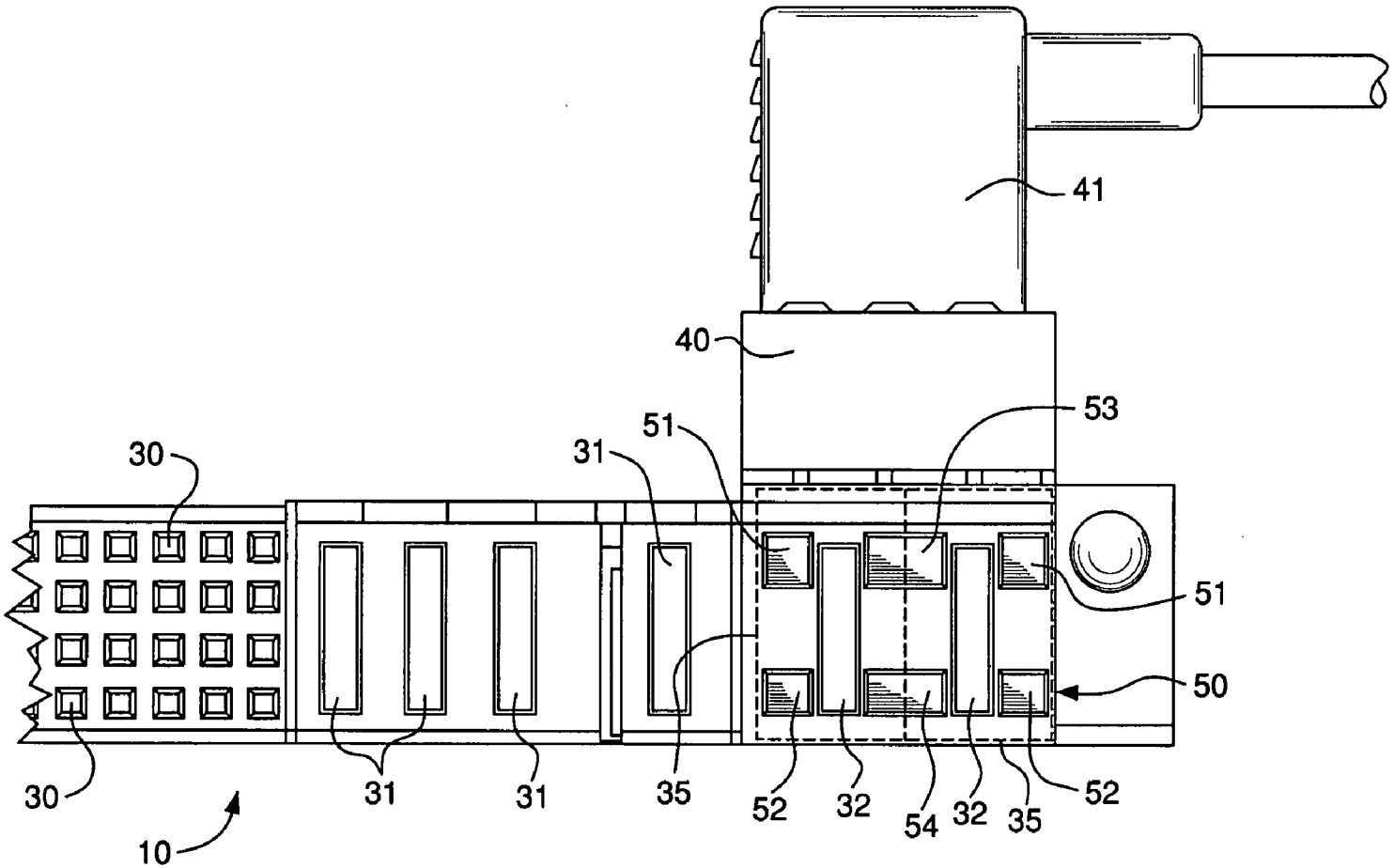
FIG. 2 is a partial front view of the electrical connector embodiment shown in FIG. 1.
Figure 3:
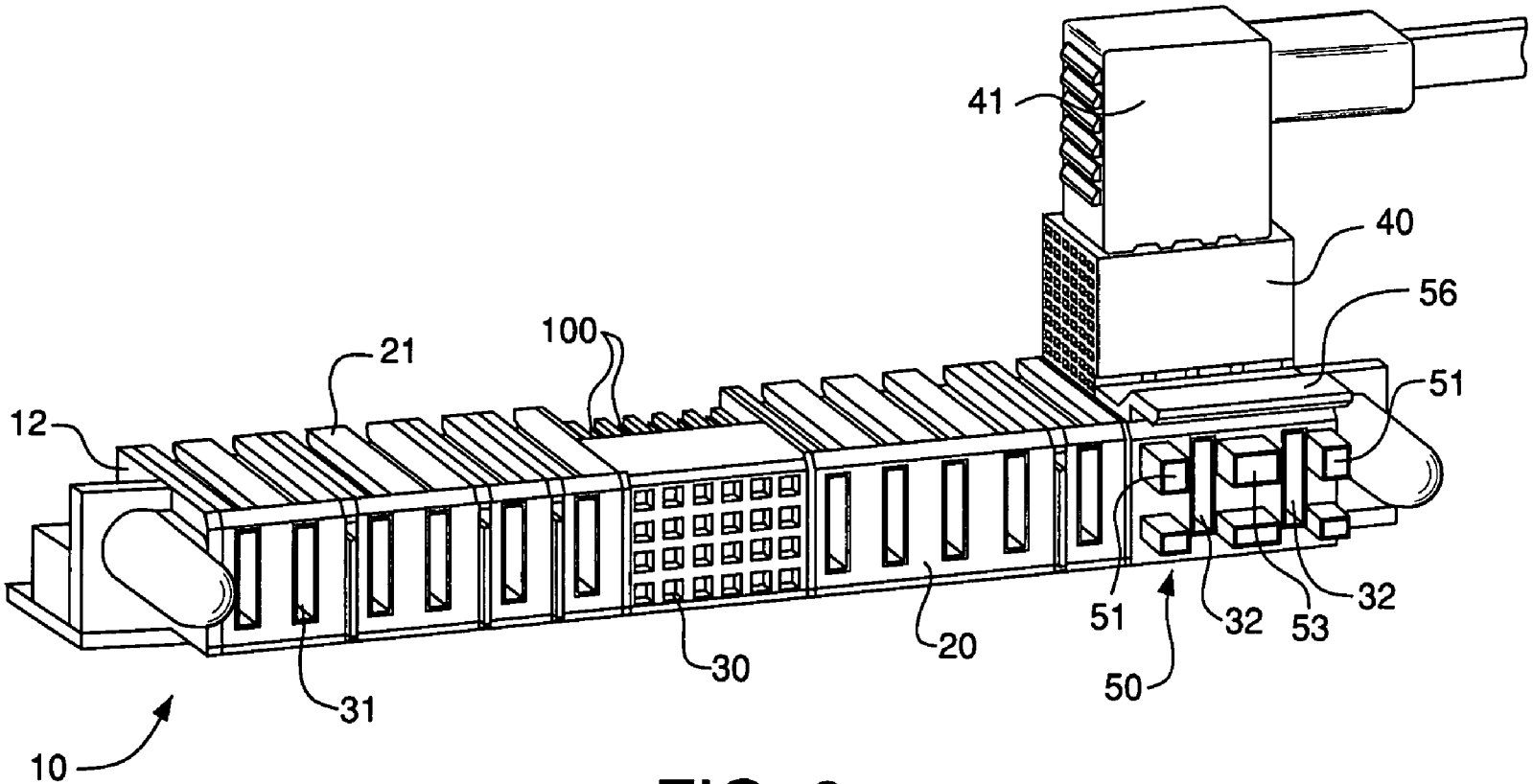
FIG. 3 is a perspective view of another electrical connector embodiment provided by the present invention including beam and hood projections extending from its mating face.
Figure 4:
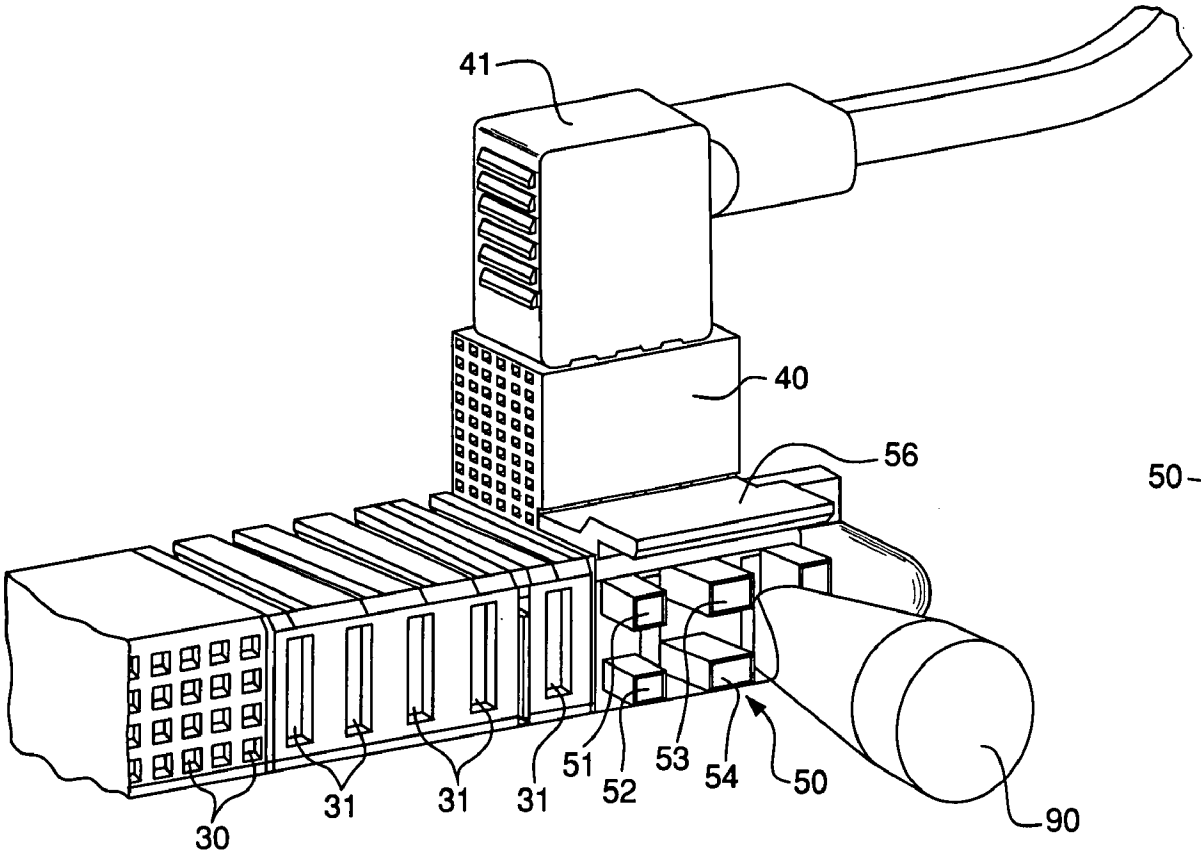
FIG. 4 is a partial perspective view of the electrical connector embodiment shown in FIG. 3, and including a simulated human digit directed towards an aperture providing access to an AC power contact.

Preferred exemplary embodiments of anti-shock guard 50 will be described with reference to FIGS. 2–5. Mating face 20 includes a perimeter area 35 associated with each of apertures 32 that provide access to AC power contacts 70. Perimeter area 35 is shown as a dotted line in FIG. 2; however, the perimeter area as included in the preferred embodiments and appended claims should not be construed as a fixed area limited to contact with or within a certain distance of apertures 32, but rather is the area generally surrounding apertures 32. Anti-shock guard 50 may comprise one or more projections extending outwardly along at least a portion of perimeter area 35. By way of example and as shown in FIGS. 2–4, two spaced apart beams 51 and 52 are disposed on one side of perimeter area 35 and two additional spaced apart beams 53 and 54 are disposed on the opposing side. A space exists between each pair of beams 51, 52 and 53, 54 to provide room for structural features employed on a complementary header connector. The space may for example, support and insulate electrical contacts extending from the header connector, or provide a latching feature. Alternative embodiments (not shown) contemplated and covered by the appended claims include, but are not limited to, a single projection disposed on opposing sides of perimeter area 35, and a single projection extending along a sufficient portion of perimeter area 35 to encompass opposing sides thereof. Connector 10 is shown having two apertures 32, with beams 53 and 54 serving as joint anti-shock guard projections on one side of the adjacent perimeter areas 35 of the two apertures. Individual, side-by-side beams could alternatively be employed that extend from the adjacent perimeter areas. Since beams 53 and 54 collectively restrict operator access to two adjacent apertures, they are preferably slightly larger than beams 51 and 52.

Now referring to FIG. 3, another projection in the form of a hood 56 preferably extends from a top position of perimeter area 35 and in between opposing beams 51 and 53. Hood 56 restricts operator access to apertures 32 from a position above connector 10. Hood 56 is shown as a single projection extending over two adjacent apertures 32; however, hood 56 could alternatively comprise multiple individual projections associated with the individual apertures. As illustrated by comparing FIGS. 1 and 3, preferred connectors may include an anti-shock guard 50 having one type of projection discussed above (beam and hood) and not the other.

Figure 5:
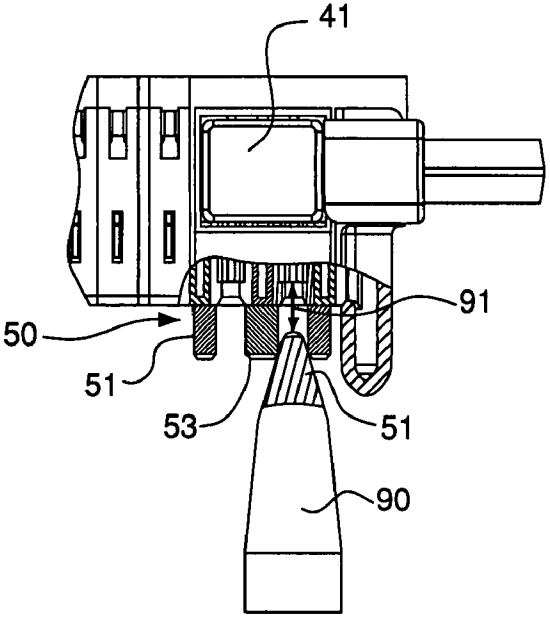
FIG. 5 is partial cutaway view of the electrical connector embodiment shown in FIG. 3, illustrating a safety gap between a simulated human digit and a power contact housed with the connector.

As can be seen in FIGS. 4 and 5, a simulated human digit 90 directed towards an aperture 32 is restricted from touching the hot AC power contact 70 accessible via aperture 32. A safety gap 91 of at least 5 mm is provided between simulated human digit 90 and an engaging portion of the AC power contact.

Housing 12, AC cable port 40, and anti-shock guard 50 are preferably molded or formed from a glass-filled high temperature nylon or other materials known to one having ordinary skill in the art. AC cable port 40 and anti-shock guard 50 may be integrally molded with housing 12, or alternatively, be manufactured separately and then coupled to housing 12.

Figure 6:
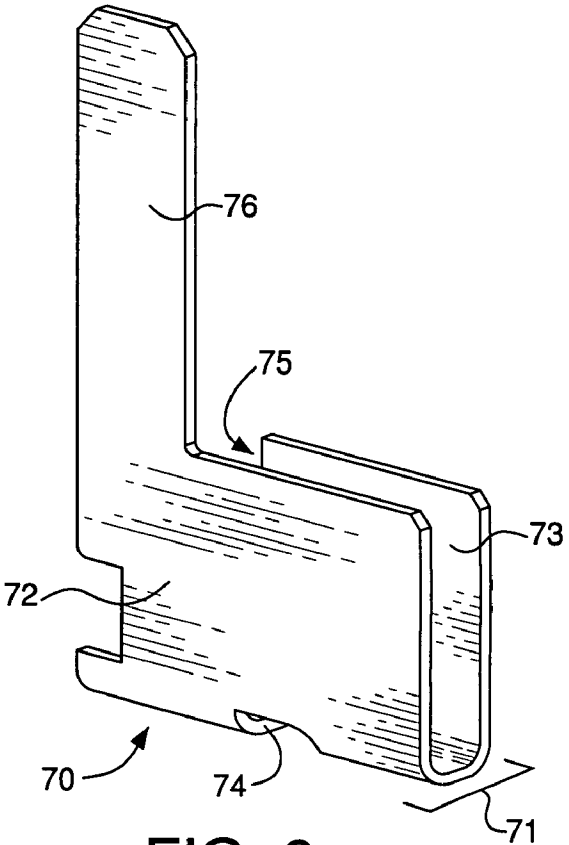
FIG. 6 is a perspective view of an AC power contact embodiment comprising two spaced apart contact walls and a tab extending from one of the contact walls.

Power circuits can undergo changes in electrical properties because of the relatively high current flows, for example, on the order of 30 amps or more in certain electronic equipment. Preferred power contacts are designed to dissipate heat generated from power transmission so that changes in circuit characteristics are minimized. A preferred AC power contact 70 is shown in FIG. 6, comprising an engaging portion 71 having two spaced apart contact walls 72 and 73 connected by a bridging element 74. Employing two contact walls increases the electrical integrity of the connector. Also, the two contact walls in conjunction with intermediate space 75 increases the ability and rate of heat dissipation. A tab 76 extends from contact wall 72 for engaging AC power cable plug 41. Although not shown, both contact walls 72 and 73 may include a tab for engaging an external power supply.

Figure 7:
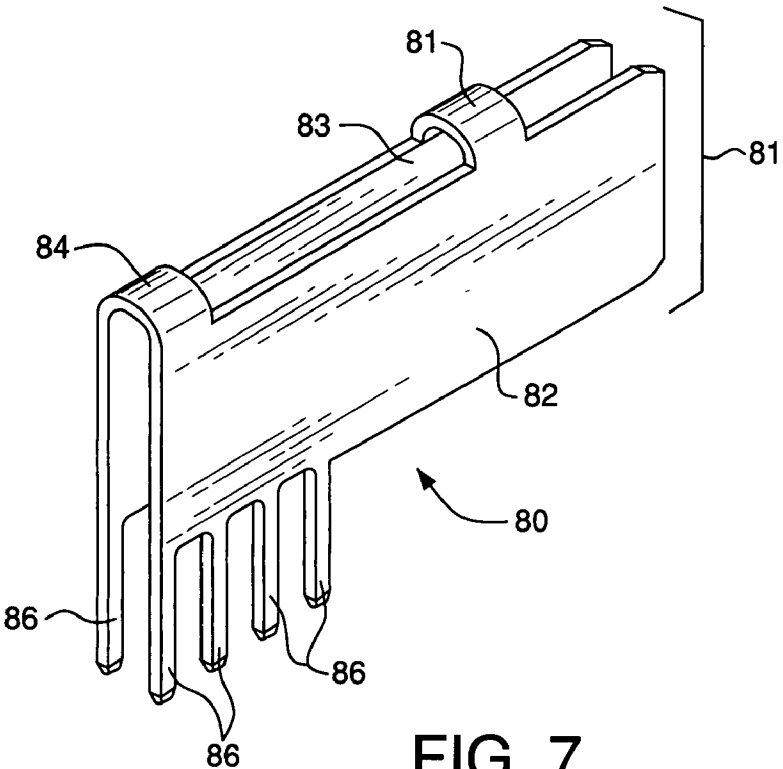
FIG. 7 is a perspective view of a DC power contact embodiment comprising two spaced apart contact walls and a plurality of terminals extending from each of the contact walls.

Referring now to FIG. 7, a preferred DC power contact 80 is shown, similar to the preferred AC power contact 70, comprising an engaging portion 81 having two spaced apart contact walls 82 and 83 connected by a bridging element 84. One or both, as shown in FIG. 7, of contact walls 82 and 83 have terminals 86 for connection with a circuit board (not shown).

Power contacts 70 and 80 are preferably loaded into housing 12 from the rear. The contact walls and/or bridging element of the AC and DC power contacts 70, 80 may contain notches or other female elements, and/or tangs or other male elements for retaining the power contacts in housing 12. Preferred power contacts 70 and 80 are stamped or otherwise formed as single piece from suitable materials such as phosphor bronze alloys or beryllium copper alloys. Signal contacts 100 (shown in FIG. 1 disposed in housing 12) are preferably "pin-type" contacts that include tail portions for connection with a circuit board, and are made from suitable materials, such as, for example, copper alloys. The power and signal contacts may be plated with gold, or a combination of gold and nickel.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed:

1. An electrical connector, comprising:

an insulative housing;

a first power contact disposed within the insulative housing and accessible via a first aperture formed in a mating face of the housing forward of the first power contact;

a second power contact disposed within the insulative housing and next to the first power contact, the second power contact being accessible via a second aperture formed in the mating face of the housing forward of the second power contact, wherein each of the first power contact and the second power contact comprises a pair of opposed contact walls separated by an open space therebetween; and an anti-shock projection positioned between the first power contact and the second power contact, wherein the anti-shock projection extends forwardly from the mating face of the housing and is located entirely forward of any edge of the first power contact and the second power contact and hinders access to the first power contact or the second power contact.

2. The electrical connector according to claim 1, wherein each of the first power contact and the second power contact further comprises a bridging member extending between the pair of opposed and spaced apart contact walls.

3. The electrical connector according to claim 1, further comprising a plurality of pin contacts disposed in said insulative housing for transmitting signals.

4. The electrical connector according to claim 1, wherein the housing has a mating face and the first and second contacts are positioned entirely on one side of the mating face.

5. The electrical connector according to claim 1, wherein a forward end of each of the first and second contacts is accessible by way of a corresponding aperture formed in the housing.

6. An electrical connector, comprising:

an insulative housing;

a first array of power contacts disposed in the insulative housing;

a second array of power contacts disposed in the insulative housing, wherein a forward end of each of the power contacts in at least one of the first and the second arrays of power contacts is accessible by way of a corresponding aperture formed in the housing; and an anti-shock guard associated with power contacts within only one of the first array of power contacts and the second array of power contacts.

7. The electrical connector according to claim 6, wherein the anti-shock guard is defined by a pair of opposing projections positioned on either side of the power contacts.

8. The electrical connector according to claim 6, wherein each of the power contacts within the first array of power contacts comprises a pair of opposed and spaced apart contact walls.

9. The electrical connector according to claim 6, further comprising an array of pin contacts disposed in the insulative housing for transmitting signals.

10. The electrical connector according to claim 9, wherein the array of pin contacts is located between the first array of power contacts and the second array of power contacts.

11. The electrical connector according to claim 8, wherein each of the power contacts within the second array of power contacts comprises a pair of opposed and spaced apart contact walls.

12. The electrical connector according to claim 11, wherein each of the power contacts of the first and the second arrays of power contacts further comprises a bridging element extending between the contact walls.

13. An electrical connector, comprising:

an insulative housing including a connector mating face;

a first array of power contacts disposed in the insulative housing;

a second array of power contacts disposed in the insulative housing, wherein each of the power contacts in at least one of the first and the second arrays of power contacts is positioned entirely on a first side of the connector mating face;

an array of signal contacts disposed between the first array of power contacts and the second array of power contacts; and an anti-shock guard projecting from the connector mating face and being located entirely on a second side of the connector mating face.

14. The electrical connector according to claim 13, wherein each of the signal contacts is a pin contact.

15. The electrical connector according to claim 13, wherein the anti-shock guard is associated with less than all of the first array of power contacts, the second array of power contacts, and the array of signal contacts.

16. The electrical connector according to claim 13, wherein the anti-shock guard is associated with only the second array of power contacts.

17. The electrical connector according to claim 13, wherein the power contacts within the first array of power contacts and/or the second array of power contacts comprise a pair of opposed and spaced apart contact walls.

18. The electrical connector according to claim 17, wherein a bridging element spans the pair of opposed and spaced apart contact walls.

* * * * *